US008495993B2

(12) United States Patent
Rice et al.

(10) Patent No.: US 8,495,993 B2
(45) Date of Patent: Jul. 30, 2013

(54) ENGINE INCLUDING CRANKCASE VENTILATION SYSTEM OIL DRAIN FEATURES

(75) Inventors: Alan E. Rice, New Baltimore, MI (US); Thomas A. Spix, Rochester Hills, MI (US)

(73) Assignee: GM Global Technology Operations LLC

( * ) Notice: Subject to any disclaimer, the term of this patent is extended or adjusted under 35 U.S.C. 154(b) by 127 days.

(21) Appl. No.: 13/196,247

(22) Filed: Aug. 2, 2011

(65) Prior Publication Data

US 2012/0304971 A1 Dec. 6, 2012

Related U.S. Application Data

(60) Provisional application No. 61/492,848, filed on Jun. 3, 2011.

(51) Int. Cl.
*F02M 25/06* (2006.01)

(52) U.S. Cl.
USPC ..... 123/572

(58) Field of Classification Search
USPC ..... 123/572–574, 41.86
See application file for complete search history.

(56) References Cited

U.S. PATENT DOCUMENTS

| | | | | |
|---|---|---|---|---|
| 4,597,372 | A * | 7/1986 | Furukawa | 123/572 |
| 4,790,287 | A * | 12/1988 | Sakurai et al. | 123/573 |
| 4,844,032 | A * | 7/1989 | Groeger et al. | 123/196 R |
| 5,647,337 | A * | 7/1997 | Johnson et al. | 123/572 |
| 5,957,118 | A * | 9/1999 | Tateno et al. | 123/573 |
| 8,151,778 | B2 * | 4/2012 | Lewis et al. | 123/572 |
| 2002/0083934 | A1 * | 7/2002 | Ruehlow et al. | 123/573 |
| 2007/0181108 | A1 * | 8/2007 | Shieh | 123/572 |
| 2009/0188478 | A1 * | 7/2009 | Terada et al. | 123/572 |

* cited by examiner

*Primary Examiner* — Marguerite McMahon
(74) *Attorney, Agent, or Firm* — Harness, Dickey & Pierce, P.L.C.

(57) ABSTRACT

An engine assembly includes an engine structure, an air intake assembly and a positive crankcase ventilation system. The engine structure defines an intake port and a crankcase. Furthermore, the air intake assembly is in communication with the intake port. The positive crankcase ventilation system includes a fresh air line, a housing and a foul air line. The fresh air line is in communication with the air intake assembly and the crankcase. The housing defines an air inlet and an air outlet with the air inlet being in communication with the crankcase and partially defined by a wall extending into an inner volume of the housing. An oil separation mechanism may be located in the housing between the air inlet and the air outlet. The foul air line is in communication with the air intake assembly and the air outlet.

5 Claims, 3 Drawing Sheets

ENGINE INCLUDING CRANKCASE VENTILATION SYSTEM OIL DRAIN FEATURES

CROSS-REFERENCE TO RELATED APPLICATIONS

This application claims the benefit of U.S. Provisional Application No. 61/492,848, filed on Jun. 3, 2011. The entire disclosure of the above application is incorporated herein by reference.

FIELD

The present disclosure relates to engine positive crankcase ventilation systems.

BACKGROUND

This section provides background information related to the present disclosure which is not necessarily prior art.

Internal combustion engines may combust a mixture of air and fuel in cylinders and thereby produce drive torque. A portion of the combustion gases (blowby) may escape the combustion chamber past the piston and enter the engine crankcase. Crankcase ventilation systems may be incorporated into engines in order to mitigate the effects of blowby gases in the crankcase.

SUMMARY

An engine assembly may include an engine structure, an air intake assembly and a positive crankcase ventilation system. The engine structure may define an intake port and a crankcase. Furthermore, the air intake assembly may be in communication with the intake port. The positive crankcase ventilation system may include a fresh air line, a housing and a foul air line. The fresh air line may be in communication with the air intake assembly and the crankcase. The housing may define an air inlet and an air outlet with the air inlet being in communication with the crankcase and partially defined by a wall extending into an inner volume of the housing. An oil separation mechanism may be located in the housing between the air inlet and the air outlet. The foul air line may be in communication with the air intake assembly and the air outlet.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
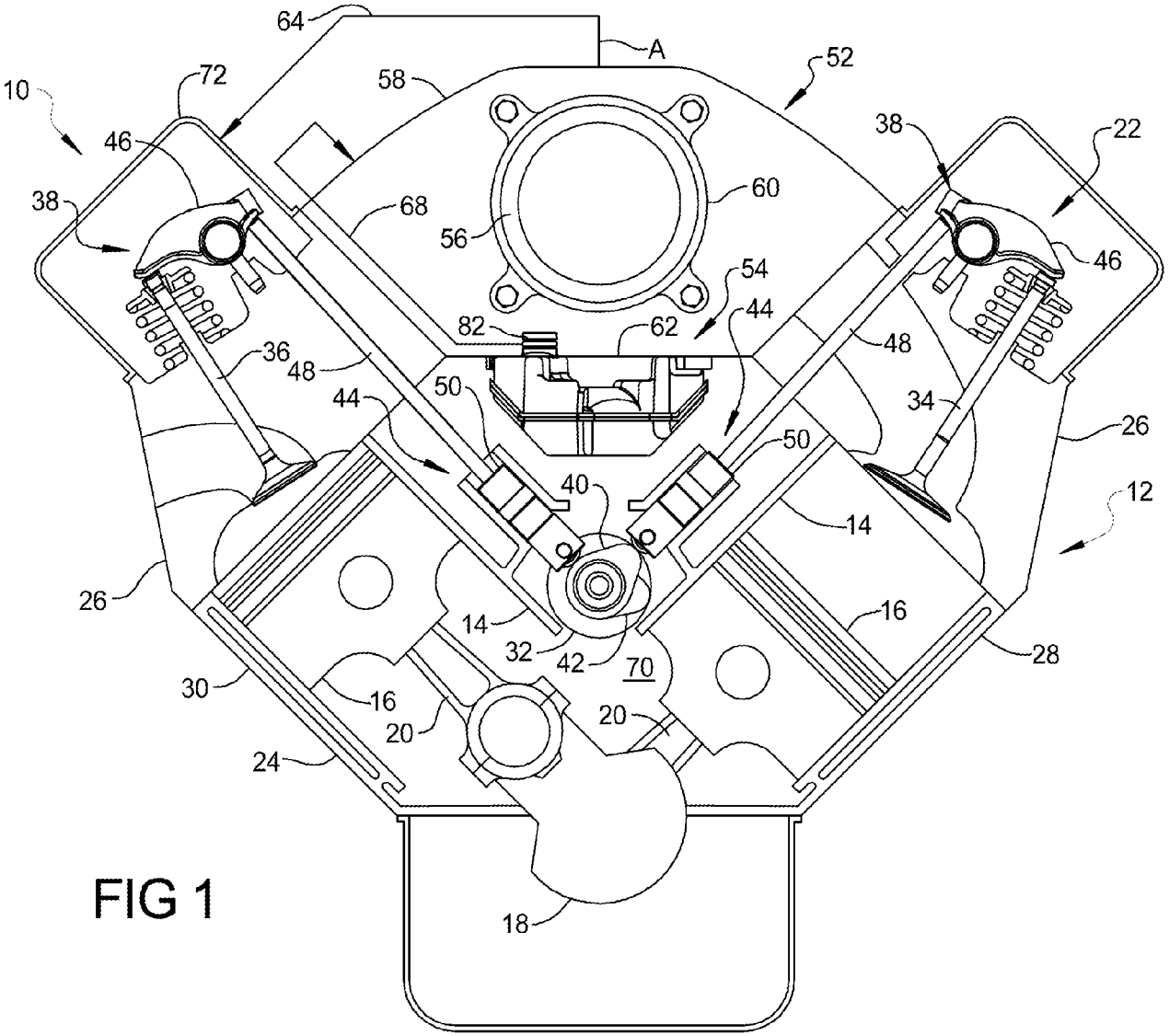
FIG. 1 is a schematic section view of an engine assembly according to the present disclosure.

With reference to FIG. 1, an engine assembly 10 is illustrated. The engine assembly 10 may include an engine structure 12 defining cylinder bores 14, pistons 16 disposed within the cylinder bores 14, a crankshaft 18, connecting rods 20 coupling the pistons 16 to the crankshaft 18, and a valvetrain assembly 22. The engine structure 12 may include an engine block 24 defining the cylinder bores 14 and cylinder heads 26 coupled to the engine block 24. The engine block 24 may define a V-configuration having first and second banks 28, 30 of cylinder bores 14 disposed at an angle relative to one another. The first bank 28 may define a first set of cylinder bores 14 arranged longitudinally in series and the second bank 30 may define a second set of cylinder bores 14 arranged longitudinally in series. However, it is understood that the present disclosure is not limited to engines including a cam-in-block design or V-configuration engines.

The valvetrain assembly 22 may include a camshaft 32, intake and exhaust valves 34, 36, and a valve actuation assembly 38. The camshaft 32 may include intake and exhaust lobes 40, 42. The valve actuation assembly 38 may be engaged with the intake and exhaust lobes 40, 42 and the intake and exhaust valves 34, 36 to selectively open the intake and exhaust valves 34, 36. The valve actuation assembly 38 may include valve lift mechanisms 44 and rocker arms 46. The valve lift mechanisms 44 may each include a pushrod 48 engaged with the rocker arm 46 and a lifter 50 engaged with the camshaft 32.

The engine assembly 10 may additionally include an air intake assembly 52 and a positive crankcase ventilation (PCV) system 54. The air intake assembly 52 may include an air induction system 56 in communication with a fresh air supply (A) and an intake manifold 58 in communication with the air induction system 56 via a throttle body 60. The PCV system 54 may include a PCV air-oil separator 62, a fresh air line 64 and a foul air line 68. The fresh air line 64 may be in communication with the engine crankcase 70 and the air intake assembly 52. In the present non-limiting example, the PCV air-oil separator 62 is located in a valley of the engine block 24 between the first and second banks 28, 30 and the fresh air line 64 extends from the cylinder head cover 72 to the air induction system 56. The fresh air line 64 may be in communication with the crankcase 70 through passages (not shown) in the cylinder heads 26 and may provide fresh air flow into the crankcase 70.

Figure 2:
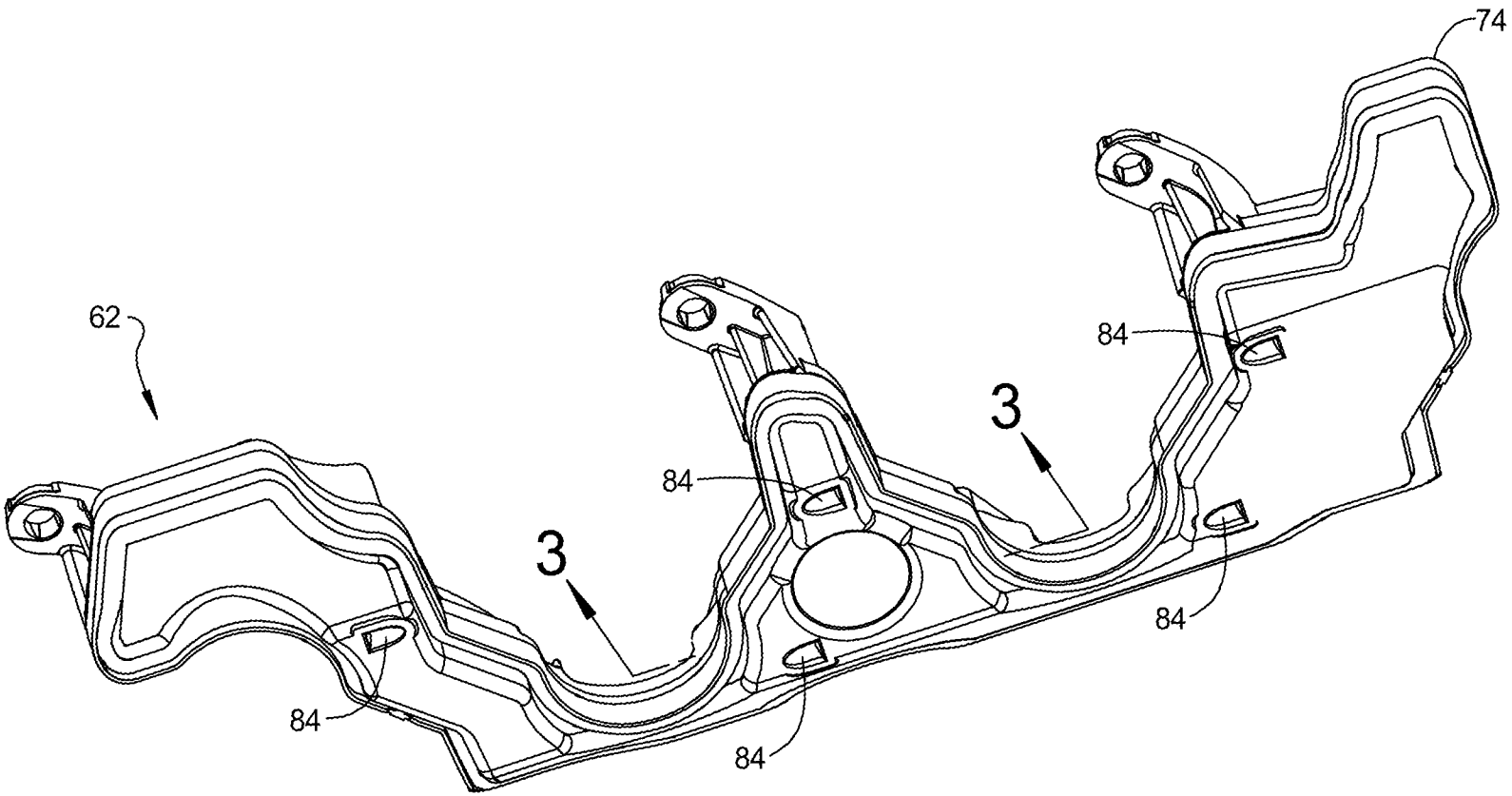
FIG. 2 is perspective view of the air-oil separator in the positive crankcase ventilation system from the engine assembly shown in FIG. 1.
Figure 3:
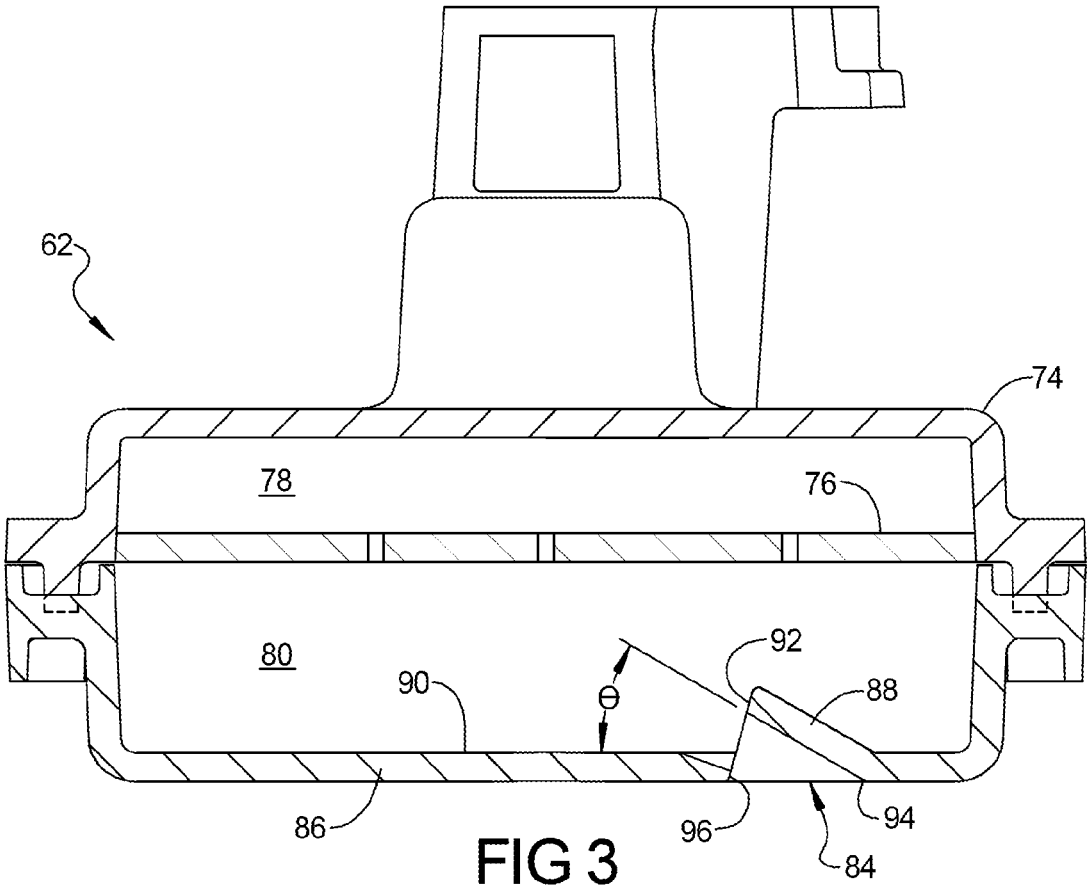
FIG. 3 is a fragmentary section view of the air-oil separator in the positive crankcase ventilation system shown in FIG. 2.

The foul air line 68 may be in communication with the PCV air-oil separator 62 and the air intake assembly 52. In the present non-limiting example, the foul air line 68 extends from the PCV air-oil separator 62 to the intake manifold 58. With additional reference to FIGS. 2 and 3, the PCV air-oil separator 62 may include a housing 74 and an air-oil separation mechanism 76 located within the housing 74 and separating the PCV air-oil separator 62 into first and second regions 78, 80. The air-oil separation mechanism 76 may take a variety of forms including, but not limited to, a baffle. The first region 78 may define an air outlet 82 (FIG. 1) in communication with the foul air line 68 and the second region 80 may be in communication with passages 84 defined in a lower portion 86 of the housing 74 defined by the PCV air-oil separator 62 and forming air inlets and oil drains.

The passages 84 may be similar to one another. Therefore, a single passage 84 will be described with the understanding that the description applies equally to each of the passage 84. The passage 84 may provide blowby gas flow from the crankcase 70 to the foul air line 68 while allowing oil separated from the blowby flow to drain back to the crankcase 70. Therefore, the passage 84 may form an air inlet to the housing 74 and an oil drain passage.

The lower portion 86 may be located above the crankcase 70 and the passage 84 may face the crankcase 70. The passage 84 may be defined by a wall 88 extending into an inner volume of the housing 74. More specifically, the wall 88 may extend into the second region 80 above a lower interior surface 90 of the lower portion 86, defining an end 92 of the wall 88 within the second region 80. The wall 88 may extend into the second region 80 at an angle (θ) of between thirty and forty degrees relative to the lower portion 86 of the housing 74 and may form upper surface of the passage 84. In the present non-limiting example, the angle (θ) is approximately thirty-three degrees. The wall 88 may extend at a first perimeter region 94 of the passage 84 and a second perimeter region 96 of the passage 84 may terminate at the lower interior surface 90 of the lower portion 86.

During engine operation, blowby gas may flow from the crankcase 70 through the passage 84 at the first perimeter region 94 adjacent to the wall 88. Oil may be separated from the blowby gas flow by the air-oil separation mechanism 76 and may accumulate in the lower portion 86 of the PCV air-oil separator 62. The oil may drain back to the crankcase 70 via a return flow path defined at the second perimeter region 96 of the passage 84. The orientation of the wall 88 may result in a maximum air flow velocity being defined adjacent to the wall 88. With the maximum air flow velocity located adjacent to the wall 88, oil may drain to the crankcase 70 via the passage 84 at a location opposite the wall 88 without encountering the high air flow velocity that may otherwise inhibit oil flow through the passage 84.

What is claimed is:

1. A positive crankcase ventilation system comprising:

a housing defining an air inlet and an air outlet, the air inlet providing communication between an engine crankcase and an inner volume of the housing; and an air-oil separation mechanism located within the housing between the air inlet and the air outlet, wherein a lower portion of the housing includes a wall extending into an interior of the housing at an angle of between 30° and 40° relative to a lower interior surface and extending directly from the lower interior surface for defining an upper surface of an oil drain passage.

2. The positive crankcase ventilation system of claim 1, further comprising a fresh air line in communication with an engine air intake assembly and an engine crankcase and a foul air line in communication with the engine air intake assembly and the air outlet.

3. The positive crankcase ventilation system of claim 2, wherein the air inlet faces the engine crankcase.

4. The positive crankcase ventilation system of claim 3, wherein the lower portion is located above the engine crankcase.

5. An engine assembly comprising:

an engine structure defining an intake port and a crankcase;

an air intake assembly in communication with the intake port; and a positive crankcase ventilation system including:

a fresh air line in communication with the air intake assembly and the crankcase;

a housing defining an air inlet and an air outlet, the air inlet being in communication with the crankcase, wherein a lower portion of the housing includes a wall extending into an interior of the housing at an angle of between 30° and 40° relative to a lower interior surface and extending directly from the lower interior surface for defining an upper surface of an oil drain passage; and an air-oil separation mechanism located within the housing between the air inlet and the air outlet.

* * * * *